US005099587A

United States Patent [19]

Jarosch

[11] Patent Number: 5,099,587

[45] Date of Patent: Mar. 31, 1992

[54] BATHROOM DRYER ASSEMBLY

[76] Inventor: Robert M. Jarosch, 3128 N. 52nd St., Phoenix, Ariz. 85018

[21] Appl. No.: 527,524

[22] Filed: May 23, 1990

Related U.S. Application Data

[63] Continuation-in-part of Ser. No. 330,192, Mar. 29, 1989, abandoned, which is a continuation-in-part of Ser. No. 210.567, Jun. 23, 1988, abandoned.

[51] Int. Cl.[5] ..... F26B 19/00

[52] U.S. Cl. ..... 34/202; 34/243 R; 34/90; 34/233; 34/225; 392/371; 392/380; 392/381; 4/597; 4/605

[58] Field of Search ..... 34/201, 202, 90, 243 R, 34/233, 225; 4/596, 597, 598, 605, 612, 614; 98/31, 36; 219/374, 362, 366, 368, 375, 370, 353; 392/360, 363, 364, 370, 371, 379-381

[56] References Cited

U.S. PATENT DOCUMENTS

| | | | |
|---|---|---|---|
| 2,568,278 | 9/1951 | Favot | 219/39 |
| 3,128,161 | 4/1964 | Hudon | 34/233 |
| 3,282,193 | 11/1966 | Jennings | 98/36 |
| 3,449,838 | 6/1969 | Chancellor, Jr. | 34/90 |
| 3,587,118 | 6/1971 | Compton | 4/146 |
| 3,641,312 | 2/1972 | Ammerman et al. | 219/374 |
| 3,701,170 | 10/1972 | Bond | 4/174 |
| 3,713,176 | 1/1973 | Stock | 4/1 |
| 3,755,826 | 9/1973 | Roberts | 4/1 |
| 3,878,621 | 4/1975 | Duerre | 34/90 |
| 4,233,692 | 11/1980 | sinsley | 4/662 |
| 4,348,777 | 9/1982 | Peterson | 4/596 |
| 4,433,719 | 2/1984 | Cherry et al. | 236/51 |
| 4,594,797 | 6/1986 | Houck, Jr. | 34/233 |
| 4,780,595 | 10/1988 | Alban | 219/370 |

FOREIGN PATENT DOCUMENTS

| | | | |
|---|---|---|---|
| 360434 | 11/1931 | United Kingdom | 219/353 |

*Primary Examiner*—Henry A. Bennett
*Assistant Examiner*—Denise L. F. Gromada
*Attorney, Agent, or Firm*—Richard G. Harrer; Charles E. Cates

[57] ABSTRACT

An assembly for efficiently supplying heated air to an enclosed area for drying the body of a person after bathing. The assembly has particular application for installation in an existing bathing area with a minimum of remodeling and with virtually all components being installed behind the walls and ceiling of the bathing area. The assembly includes blower means, duct means and heating means of special construction and location so as to more efficiently supply heated air to the bathing area.

14 Claims, 5 Drawing Sheets

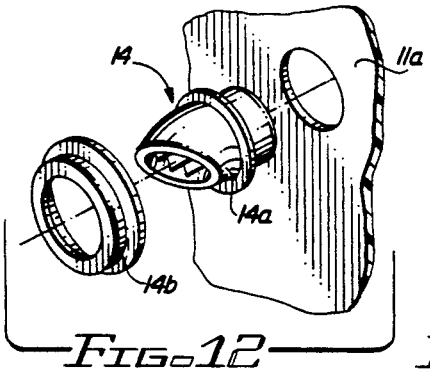
FIG. 12
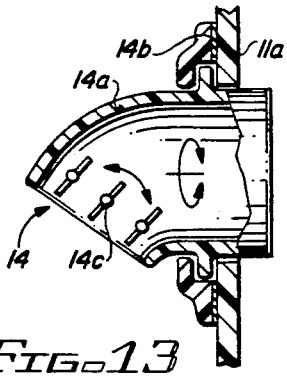
FIG. 13
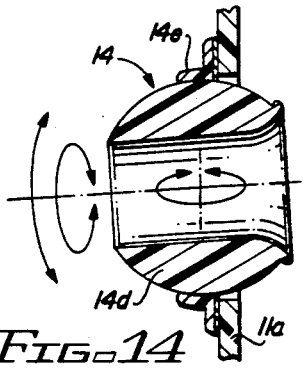
FIG. 14
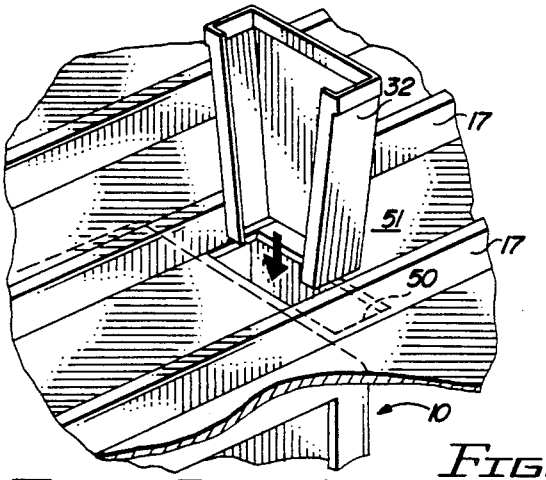
FIG. 15A
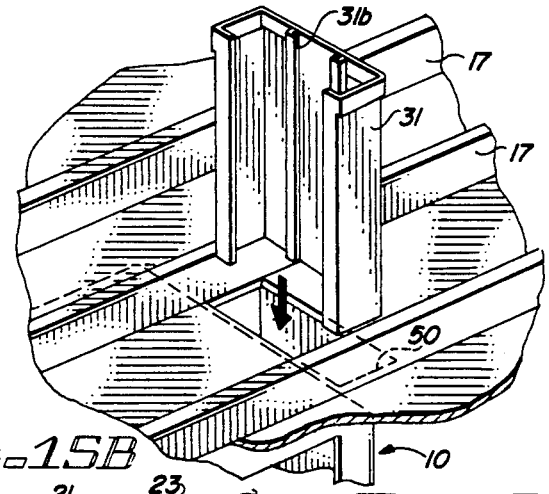
FIG. 15B
FIG. 15C
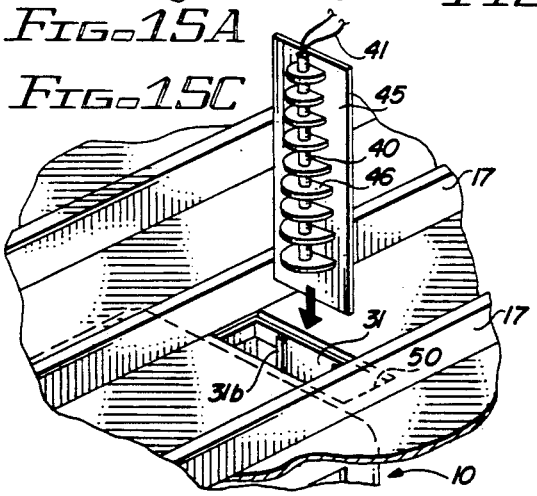
FIG. 15D
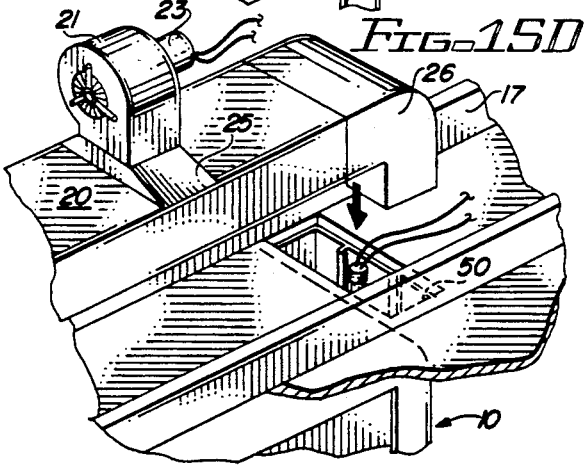
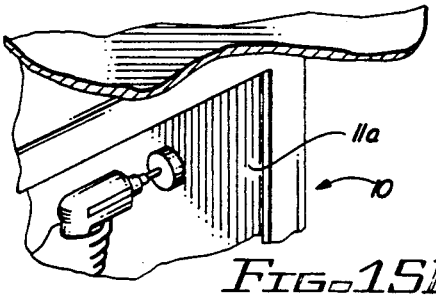
FIG. 15E
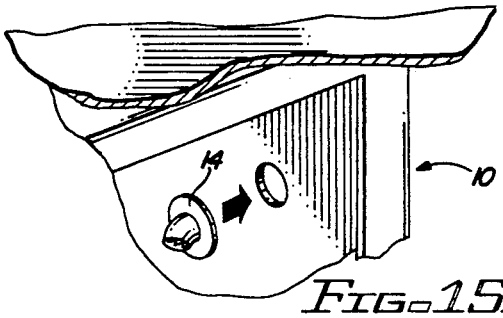
FIG. 15F

BATHROOM DRYER ASSEMBLY

This application is a continuation-in-part of application Ser. No. 07/330,192, filed Mar. 29, 1989 which in turn is a continuation-in-part of application Ser. No. 07/210,567 filed June 23, 1988 and both now abandoned.

FIELD OF THE INVENTION

This invention relates to means for delivering heated air for drying the entire body of a person and more particularly to a dryer assembly that can be readily installed in an existing bathing area such as a shower stall or bathtub area. For the most part the dryer assembly is mounted behind the interior walls of the shower stall or the like and only openings for discharge of the heated air are visible.

DESCRIPTION OF THE RELATED ART

Devices in public restrooms for supplying heated air to the face and hands are familiar to most of us. Such devices consist of a wall mounted blower in combination with an electric heating coil and serve to eliminate the need for hand towels. Most of us are also familiar with the use of infrared heating means mounted in the ceiling immediately adjacent a bathtub or shower stall which serves to warm the body of a person by radiant heat and of course does tend to assist the drying process after bathing to some degree. U.S. Pat. Nos. 3,878,621 and 3,449,838 relate to wall mounted dryers which have the capability of drying the entire body by means of heated air but are not suitable for use in a high moisture environment such as a shower stall. Additionally, U.S. Pat. Nos. 4,233,692, 3,713,176 and 3,755,826 relate to self-cleaning restrooms, each of which provide some type of means for supplying air to the restrooms to expedite the drying process of the restroom after the rooms have been suitably cleaned. Additionally, U.S. Pat. No. 4,348,777 is directed to a portable shower module which includes a ceiling heater or blower to dry the person after taking a shower. Finally, U.S. Pat. No. 3,587,118 discloses a sit-in bath which also includes means for delivering heated dryer air to the limbs and body of a bather. Although all of the foregoing do provide some type of means for drying the body of a person after bathing, none of the references disclose such means which can be readily installed in an existing bathing area such as a shower stall without extensive remodeling and which means will more efficiently deliver heated air within the area for drying the body.

SUMMARY OF THE INVENTION

The present invention is directed to providing means for drying the body. The assembly or means for this purpose is designed to be installed with a minimum of remodeling in an existing bathing area such as a shower stall or the area immediately nearby or, can be readily installed in new construction. When installed, virtually all components of the assembly are mounted outside the bathing area, that is behind the walls and above the ceiling with only the openings for discharging the heated area being visible. This is important in that it permits installation of the assembly in areas of very high moisture, typically as found in a shower stall and of course does not detract from the appearance of the area. In one embodiment, the dryer assembly includes blower means which are preferably mounted in a space immediately above and adjacent to the ceiling of the shower stall or bathing area, for example, in the attic or crawl space. Connected to the blower means are horizontally mounted duct means in the space above the shower stall and connecting with additional vertical duct means in at least one wall of the bathing area; an electrical heating element in the wall mounted vertical duct means, the electrical heating element preferably being an elongated tubular resistance type heating element which, in one embodiment, is mounted to a plate which in turn is slidably mounted within the vertical duct means. The vertical duct is preferably of 3-sided construction in the area where the duct is adjacent to the openings into the bathing area and preferably comprises two ducts which are suitably joined together to form a continuous duct. The wall of the shower stall or bathing area is provided with a series of openings which communicate with the interior of the vertical duct and a pivotable nozzle is mounted in each of said openings.

In a further embodiment which is particularly designed for installations where the vertical duct means and openings to the interior of the bathing area are installed in only one wall of the bathing area, the blower means can be mounted immediately above the vertical duct means.

A still further embodiment is designed to be used in mobile home installations where headspace is highly restricted.

BRIEF DESCRIPTION OF THE DRAWINGS

FIG. 12 is a fragmental perspective view showing mounting of an air directing nozzle;

FIGS. 13 and 14 are side elevational views of air directing nozzles;

FIGS. 15A–15F are fragmental perspective views showing a sequence of steps in installing the dryer assembly.

DESCRIPTION OF THE PREFERRED EMBODIMENTS

Figure 1:
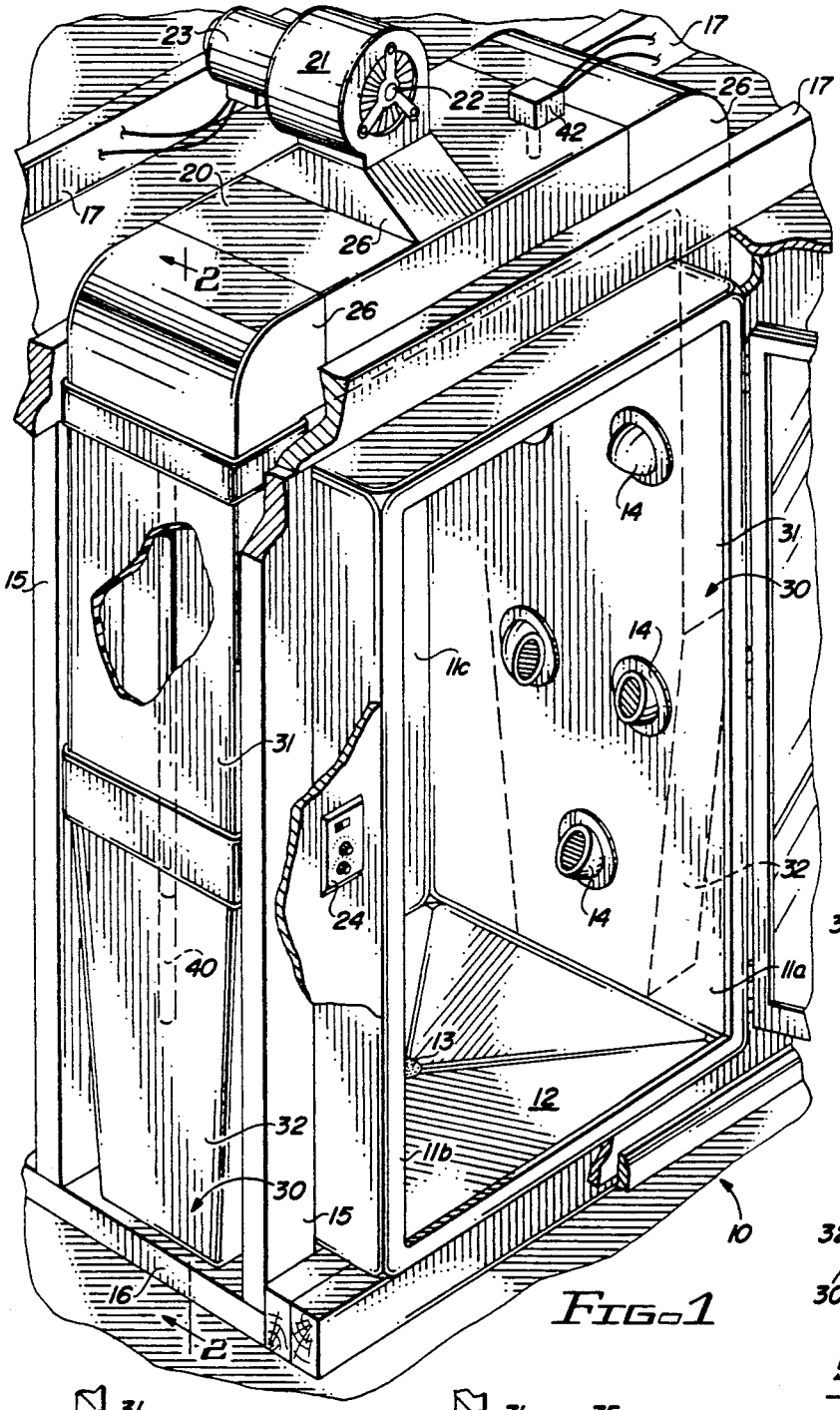
FIG. 1 is a front perspective and partly broken away view of a shower stall incorporating the dryer assembly of the invention.
Figure 2:
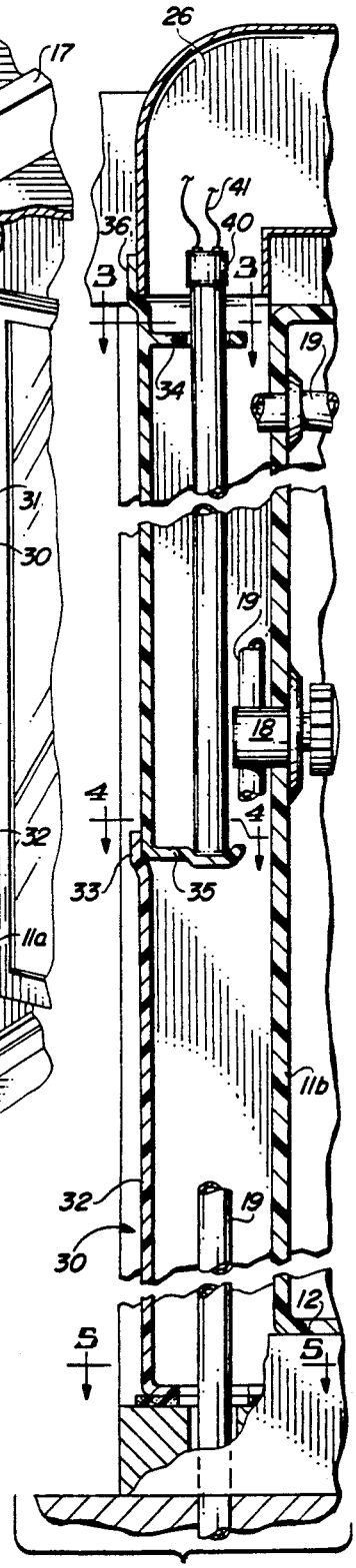
FIG. 2 is a longitudinal, vertical section view taken on the line 2—2 of FIG. 1.
Figure 3:
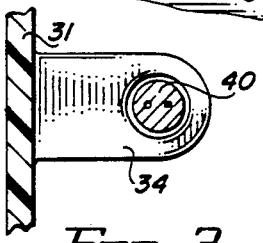
FIG. 3 is a cross sectional view taken on the line 3—3 of FIG. 2.
Figure 4:
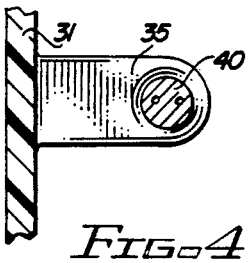
FIG. 4 is a cross sectional view taken on the line 4—4 of FIG. 2.
Figure 5:
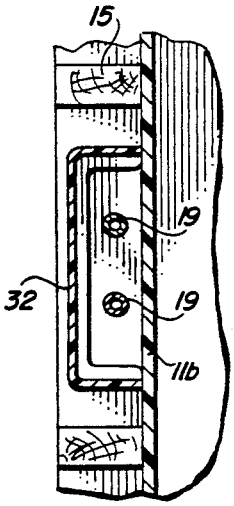
FIG. 5 is a cross sectional view taken on the line 5—5 of FIG. 2.
Figure 6:
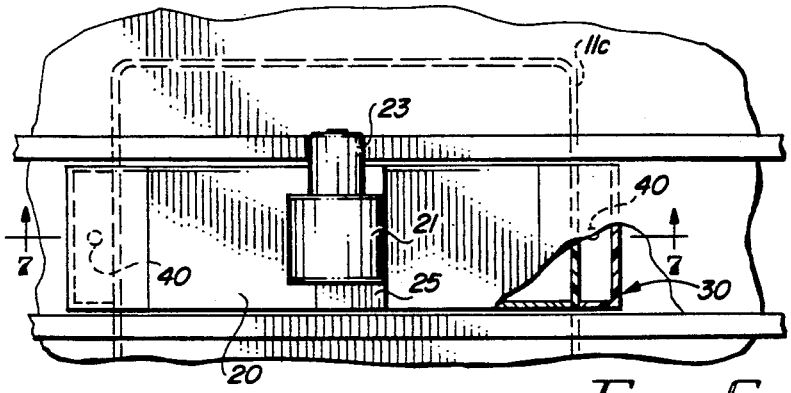
FIG. 6 is a top view of an assembly with the top duct or plenum mounted between ceiling joists.
Figure 7:
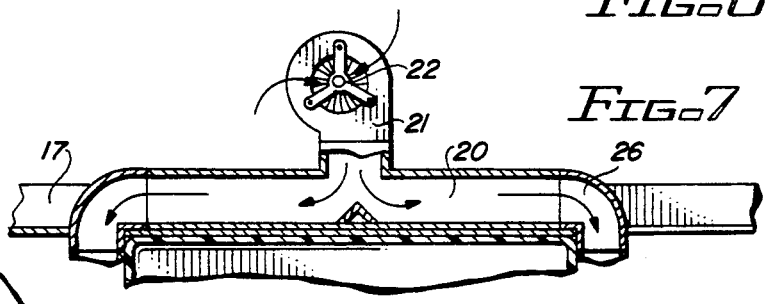
FIG. 7 is a cross sectional view taken on the line 7—7 of FIG. 6.
Figure 8:
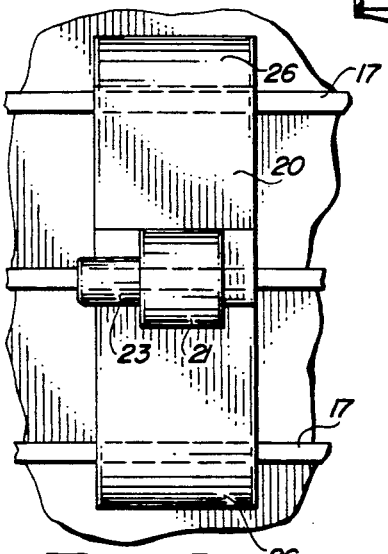
FIG. 8 is a top view of an assembly showing the top duct mounted across ceiling joists.

Referring to the drawings, FIG. 1 denotes generally a typical installation of a shower stall 10 in a building such as a home. Shower stall 10 is provided with walls 11*a*, 11*b* and 11*c*, floor 12 and a drain 13. Mounted in wall 11*a* are a series of air directing nozzles 17 which are pivotally mounted so as to be able to direct heated air at any position of the person. Although not shown, a similar series of air directing nozzles are mounted in wall 11*b*. Adjacent to each of walls 11*a* and 11*b* and on the outside of the shower stall are interior wall studs 15 which are typically 2×4 inches in size and which are shown in FIG. 1 as being adjacent to wall 11*b*. Studs 15 are nailed to bottom plate 16. Although not shown, studs 15 are also nailed to a top plate as is customary in wall construction. Above shower stall 10 are ceiling joists 17. As shown in FIG. 2 the shower stall is provided with water valve 18 and its attendant water supply pipes 19 located behind wall 11*b* and between studs 15.

Mounted immediately above shower stall 10 and between joists 17 is a horizontally positioned duct or plenum 20. Mounted above duct 20 is blower 21 which is preferably a squirrel cage turbine of standard design. Motor 23 is operatively connected to shaft 22 of the blower by suitable coupling means and is wired to a source of electricity. A control panel 24 is mounted on the exterior wall immediately adjacent the shower stall and includes a switch to turn the motor off and on. Positioned between blower 21 and horizontal duct 20 is connecting duct 25 which serves to direct air from blower 21 into horizontal duct 20.

As best shown in FIGS. 1 and 2 the dryer assembly further includes vertical ducts 30 which are connected to horizontal duct 20 by means of elbow shaped duct 26. Vertical ducts 30 are mounted immediately behind shower walls 11*a* and 11*b* and between studs 15. Preferably ducts 30 comprise two sections, that is upper section 31 and lower section 32. The upper end of section 32 is provided with a suitable flange 33 which enables the lower end of section 31 to form a seal with section 32. As shown in FIGS. 1 and 15A lower section 32 of duct 30 is tapered from side to side so that the bottom portion of duct 32 is narrower than the top portion of section 32. By constructing duct 30 in two sections with a tapered lower section I find that installation of the duct and delivery of heated air is improved. First of all it is considerably easier to install two shorter length ducts than one longer duct particularly when the ducts are to be installed in an existing bath area from the attic area. Also delivery of heated air into the shower stall by way of nozzles 14 is improved. That is, by tapering the side walls of lower section 32 of duct 30 one is able to help equalize the flow of heated air delivered through nozzles 14. I find that when sections 31 and 32 of duct 30 are of the same cross sectional area, the flow of heated air through the nozzles 14 which are located near the bottom of walls 11*a* and 11*b* is reduced as compared to the air flow through those nozzles which are located opposite upper duct section 31.

As shown best in FIGS. 2, 10, 15A and 15D, upper section 31 and lower section 32 of vertical ducts 30 are not totally enclosed but are preferably 3-sided which also serves to facilitate installation of the ducts in pre-existing construction. As seen in FIG. 2, when installing the dryer assembly in an existing shower stall, for example, one can encounter water valve 18 and water pipes 19. By employing a 3-sided duct, it may be easier to properly position the duct immediately adjacent to and behind the shower wall without having to remodel existing plumbing. Moreover, I find that even though the duct is 3-sided there is no substantial loss of air around the sides of the duct. In a customary installation where 2×4 studs are in place on 16 inch centers the dimension of the space between adjacent studs is about 14½ inches in width and 3⅝ inches in depth. The duct can be fabricated so that it is about 13–13½ inches wide and about 3½ inches deep. As noted earlier, in most installations although there may be some air escaping from the duct where the edge of the duct abuts against walls 11*a* or 11*b*, this air loss is usually not substantial. All of the ducts making up the dryer assembly can be made of sheet metal, fiberglass or other suitable material.

Positioned within vertical duct 30 is an elongated, tubular shaped resistance type heating element 40. Heating element 40 is connected by wires 41 to heat sensor 42 mounted in horizontal duct 20. The heat sensor is in turn appropriately connected to control panel 24 so that the temperature of the air may be regulated. As shown in FIG. 2, upper section 31 of duct 30 is provided with means for securing and positioning heating element 40 within the space formed by duct section 31 and shower wall 11*b*. Such means include lateral projections 34 and 35. Projection 34 is provided with opening 34*a* to position the generally circular shaped resistance heating element. Projection 35 serves to properly support the heating element within the space. The upper ends of each of ducts 31 and 32 are provided with a flanged rim area 36 and 33 respectively which facilitates the appropriate connection of the two sections of vertical duct 30 as well as the connection of duct 26 to upper vertical duct 31.

Although it is possible to mount a heating means in the horizontal duct 20 close to blower 21, I find that by using a tubular, elongated heating element and mounting it in the duct adjacent to nozzles 14, the efficiency of the delivery of heated air is enhanced.

Figure 10:
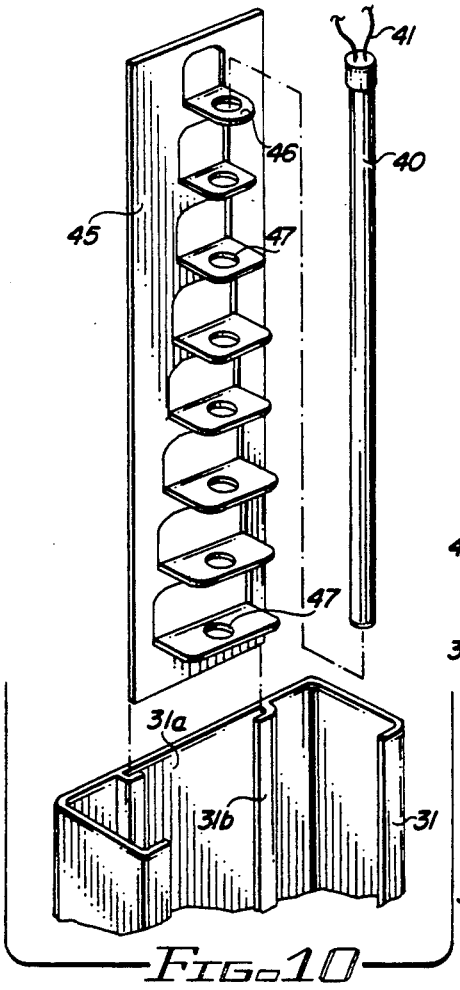
FIG. 10 is a fragmental perspective view of a vertical duct showing mounting of the heating element within the duct.
Figure 11:
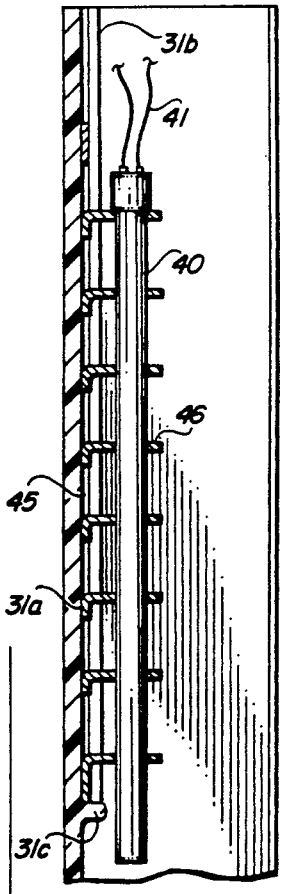
FIG. 11 is a side view showing the heating element mounted within a duct.

A means for mounting heating element 40 within duct 31 is shown in FIGS. 10 and 11. FIG. 10 shows a generally rectangular shaped mounting plate 45 constructed of a rigid material such as sheet steel or other suitable material. Projecting at about a 90° angle from plate 45 are a series of spaced apart lateral projections 46 with openings 47. As shown, the projections can be formed by making a generally U-shaped cut through a portion of plate 45 and thereafter bending projections 46 at an angle of about 90° to the mounting plate. Projections 46 serve a number of purposes. First of all, they support and properly align heating element 40 to the mounting plate 45 and ultimately in duct 31. Additionally, when the mounting plate and heating element 40 is appropriately positioned within duct 31, projections 46 help increase the conduction of heat from the heating element to the moving air. As shown in FIG. 10, the surface area of projections 46 may be gradually increased so that the area of the bottom most projection is substantially greater than that of the upper most projection.

It will further be seen from FIG. 10 that wall 31*a* of duct 31 is provided with a pair of spaced apart vertical flanges 31*b* which serve to locate and hold plate 45 in proper position within duct 31. Additionally as shown in FIG. 11 horizontal stop means 31*c* are provided in wall 31*a* to again properly locate plate 45.

FIGS. 15A–15F show a sequence of steps involved in installing the dryer assembly in existing construction. FIG. 15A shows an attic or crawl space immediately above shower stall 10. The first step in installation is to locate the appropriate place in the attic area adjacent the shower stall where the vertical duct is to be installed. After locating the area, a generally rectangular opening 50 is formed by removing the upper plate between studs 15. Thereafter section 32 of vertical duct 30 is inserted through opening 50 and lowered into position between studs 15 and immediately behind the shower wall. Thereafter, as shown in FIG. 15B duct section 31 is inserted through opening 50 and fitted together with duct 32 to form the entire vertical duct 30. As shown in FIG. 15C the next step is to insert mounting plate 45 and associated heating element 40 into the duct 31 by sliding plate 45 between flanges 31*b*. Following installation of duct 30 and heating element 40, duct 26 is fitted into flange 36 of duct 31 and center duct 20 with attendant blower 21 and motor 23 is positioned in place and attached to duct 26. This portion of the installation of the dryer assembly is completed by appropriately wiring the motor 23 to control panel 24 and connecting wires 41 to an appropriate source of power and also to thermostatic control 25.

Figure 9:
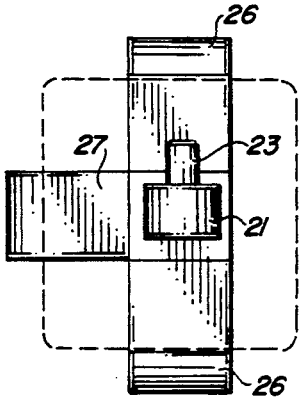
FIG. 9 is a top view of a modified top duct construction.

FIG. 9 shows a modified top duct construction and is particularly suitable for use of the dryer assembly during the warm summer months. It is appreciated that during the summer months the temperature in attic areas can be hot with temperatures of the attic air ranging as high as 140°–150° F. In such situations, it may be desirable to draw heated air from the attic area into the dryer assembly and minimize the need for utilizing the resistance heater 40. As shown in FIG. 9 center duct 20 is provided with an inlet duct 27 which is mounted at a right angle to center duct 20 and communicates with the interior of duct 20. Although not shown, the end of inlet duct 27 can be provided with a filter and an appropriate valving device which allows the duct to be opened or closed at will. In the summer months, the valving of inlet duct 27 will be opened to draw heated air from the attic area into the dryer assembly. This will minimize or in some instances completely eliminate the need for the use of the heating element 40.

The final aspect of installation involves installing nozzles 14 in the wall or walls of shower stall 10. This is easily accomplished by using a hole saw as shown in FIG. 15E and cutting an appropriate opening through shower walls 11*a* or 11*b* or both as shown in FIG. 15F. Thereafter, nozzle assembly 14, as shown in FIG. 12, is inserted in the opening in the wall of the shower stall providing communication to the interior of vertical duct 30. Nozzle assembly 14 consists of body member 14*a* and mounting ring 14*b*. The interior of nozzle body member 14*a* can be provided with air directing vanes 14*c*. As shown in FIGS. 12 and 13, the nozzle body member 14*a* is inserted through the previously cut hole in wall 11*a* and then secured into the wall by means of mounting ring 14*b*. When assembled into the wall, the nozzle is rotatable through 360°. The direction of the heated air may be further adjusted by means of vanes 14*c*. FIG. 14 shows a modified air directing nozzle member in which the nozzle body 14*d* is mounted into the wall by means of mounting ring 14*e*. The nozzle body is rotatable through 360° and also can be adjusted in virtually any lateral direction.

Figure 16:
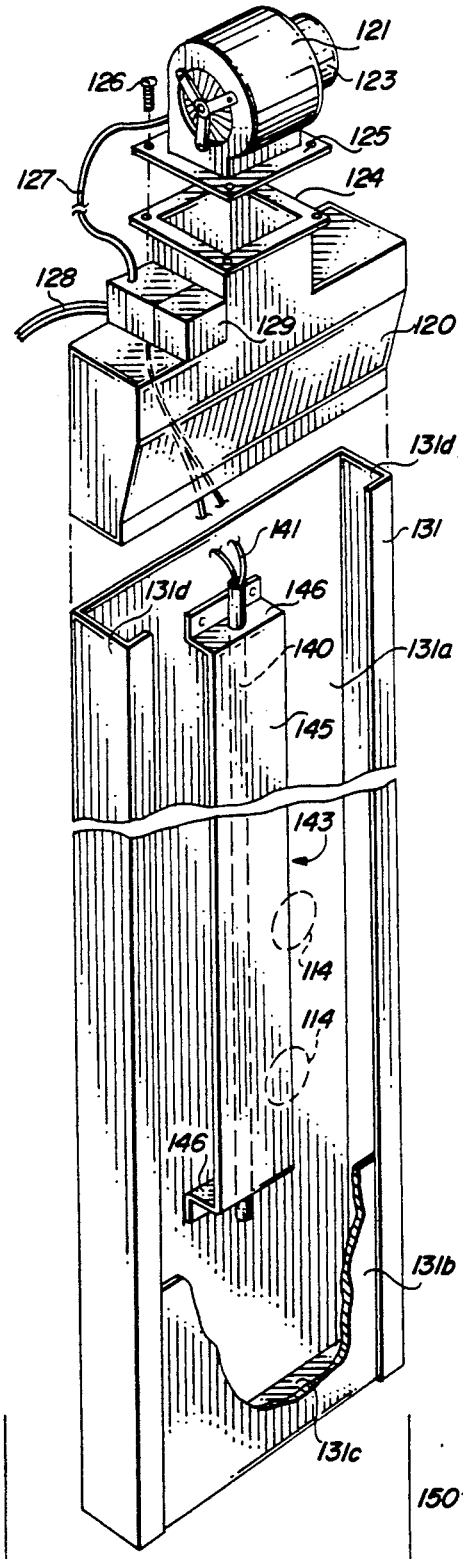
FIG. 16 is a perspective view of a further embodiment of a dryer assembly.
Figure 18:
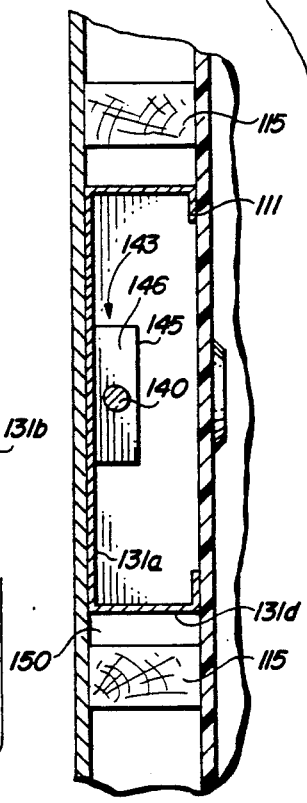
FIG. 18 is a cross sectional view taken on the line 18—18 of FIG. 17.
Figure 17:
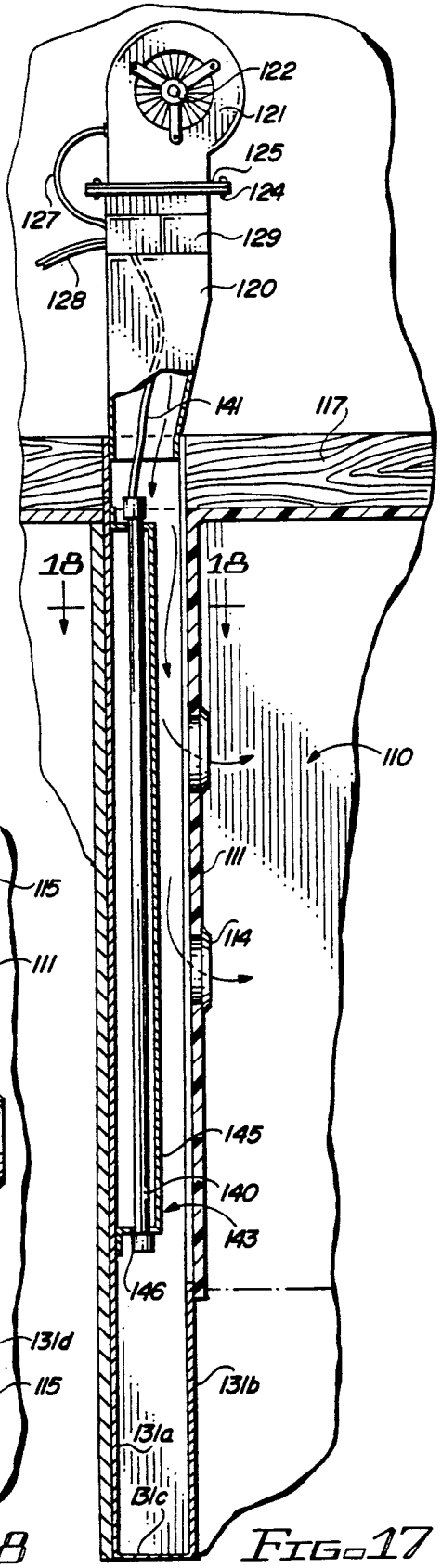
FIG. 17 is a longitudinal, vertical section view of the dryer assembly of FIG. 16 mounted in a wall.

In FIGS. 1–15F a dryer assembly was described and disclosed which was particularly suited for providing heated air through air directing nozzles mounted in two walls of a bathing area. It may be desirable or even necessary to use only one wall of the bathing area and the embodiment shown in FIGS. 16–18 is well suited for this purpose. As with other embodiments, the assembly shown in FIGS. 16–18 may use a two section vertical duct, although in this embodiment as shown only a single section duct is used. As with the previous embodiment the dryer assembly of FIGS. 16–18 uses a blower 121 which is mounted to a T-shaped plenum 120. Motor 123 is operatively coupled to shaft 122 of the blower and is connected to a junction box 129 by means of wires 127. Power to the junction box is supplied by wires 128. The plenum 120 is in turn connected to duct 131. Mounted in duct 131 is an elongated tubular shaped resistance heating element 140 which is connected to the junction box 129 by wires 141. As shown best in FIGS. 16 and 17, duct 131 is provided with mounting means 143 for securing and positioning heating element 140 within the space formed by duct 131 and wall 111 of bathing area 110. Mounting means 143 consists of a generally rectangular shaped heat reflecting plate 145, preferably of metal, which is substantially the same length as heating element 140 and which is bent at each end at a 90° angle to form a pair of legs 146 which are fastened to wall 131*a* of duct 131 by spot welding or other means. Each of legs 146 has an opening through which heating element 140 is passed. The dimension of legs 146 is such that the heating element 140 is approximately equidistant between duct wall 131*a* and shower wall 111. Mounting means 143 serves several purposes. Not only does it properly position heating element 140 in the duct, but plate member 145 acts as a shield to prevent the duct side of wall 111 from possibly becoming overheated. Moreover, plate 145 increases the efficiency of heating element 140 in heating air passing through the system and into the bathing area. That is, when element 140 becomes hot, heat is transferred from element 140 to plate 145 which in turn becomes hot. Thus a greater heated surface area is exposed to the moving air stream from blower 121.

The construction of vertical duct 131 is different from that shown in other embodiments in that the bottom portion of the duct is four sided, that is, completely enclosed. As shown best in FIGS. 16 and 17, duct 131 is three-sided throughout a substantial portion of its length and includes rear wall 131*a* and side walls 131*d*. A front wall 131*b* is provided at the lower portion of duct 131 as well as end wall 131*c*. In a preferred embodiment the fully enclosed portion of duct 131 extends upwardly about 16–20 inches from the bottom end of the duct. This construction serves several purposes. First of all if water from the bathing area were to enter the duct through the openings 111, such water would be contained within the lower portion of the duct. Moreover, in bathing areas having a bath tub, it is rather common that the interior wall or walls of the bathing area immediately adjacent to the bath tub does not extend behind the tub. That is, typically a bath tub is set in place before the interior walls are completed either by use of dry wall, plaster or the like. Thus, if a three sided duct were used in the area immediately adjacent to the tub, a considerable amount of heated air would escape from around the tub area. Moreover, even if the assembly is installed adjacent a shower stall, the use of the duct 131 still has advantages.

FIGS. 17 and 18 show the dryer assembly of FIG. 16 installed in existing construction and immediately adjacent to bathing area 110. FIG. 17 shows an attic or crawl space above the shower stall. As with other embodiments, the first step in installation is to locate the appropriate place in the attic area adjacent the bathing area where the vertical duct is to be installed. After locating the area, a generally rectangular opening 150 is cut through the upper plate exposing the area between studs 115. Thereafter, duct 131 is inserted through opening 150 and lowered into position between studs 115 and immediately behind the wall 111. The next step is to attach T-shaped plenum 120 to duct 131 or any upper extensions than may be required and then attach blower 121 and its motor 123 to plenum 120. This portion of the installation of the dryer assembly is completed by appropriately wiring motor 123 to junction box 129 and appropriate controls.

Figure 22:
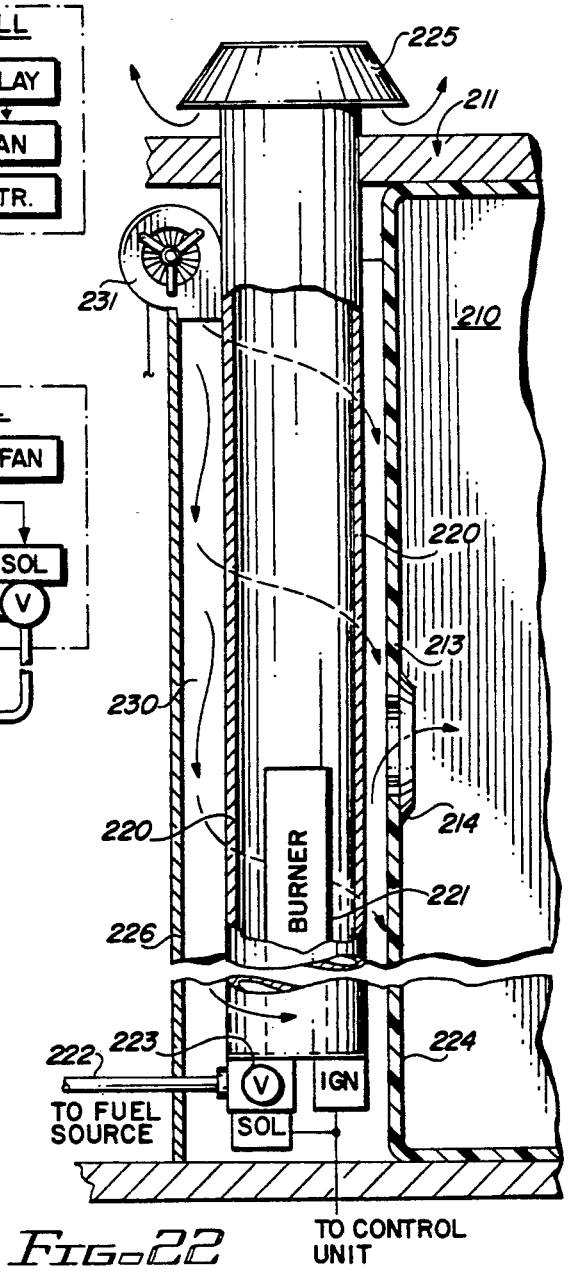
FIG. 22 is a longitudinal, vertical section view of a dryer assembly installed in a recreational vehicle.

It is also understood that a dryer assembly can be installed in a recreational vehicle but this type of installation requires special considerations. FIG. 22 is vertical sectional view of a dryer assembly installed in a recreational vehicle ("RV"). Since an RV does not have an attic or crawl space and cannot access a 110 or 220 volt power source at all times, the assembly shown in FIG. 22 utilizes propane or butane gas as a fuel and 12 volt D.C. to operate the controls. As shown in FIG. 22, the assembly consists of a cylindrical heat exchanger shown generally at 220 and vertically positioned in a space adjacent shower stall 210. The RV has roof 211 and floor 212. Mounted at the lower end of heat exchanger 220 and in its interior is gas burner 221 which is operably connected to a fuel source by means of pipe 222 and to solenoid valve 223 and 12 volt ignition 224. Heat exchanger 220 is constructed of heavy gauge steel or other suitable fire-resistant and heat conductive material and extends upwardly through roof 211 and is topped off with weather cap 225. As in other embodiments, shower wall 213 is provided with one or more air directing nozzles 214 which communicate from the space surrounding exchanger 220 to the interior of shower stall 210. On the side of the exchanger 220 opposite from shower wall 213 is an interior wall 226 which separates the dryer assembly from the other areas of the RV. The generally cylindrical shaped heat exchanger is surrounded by a substantially enclosed chamber 230 throughout substantially the entire length of the heat exchanger. Chamber 230 is preferably lined with sheet metal or other fire resistant material and functions as a plenum. Blower 231, mounted at the top of chamber 230, circulates air from another portion of the RV or outside air through the chamber and around the heat exchanger and ultimately through air nozzle 214 into the shower stall.

In the embodiment shown, blower 231 is mounted at the top of chamber 230, because of space limitations. Recently, some RV's are built with so-called "basements" which means that the RV is provided with a storage area beneath the floor of the vehicle. If an RV has a basement, then it would be preferable to mount the blower in that area beneath the floor of the RV and then, by means of suitable ducts, circulate air into the chamber surrounding the heat exchanger.

Figure 19:
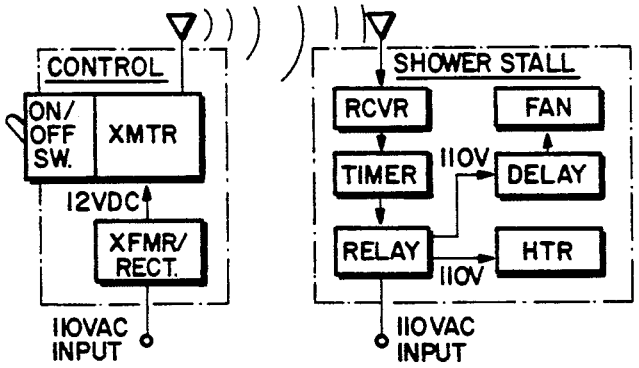
FIG. 19 is a schematic diagram of a radio-controlled system for use with the dryer assembly.
Figure 20:
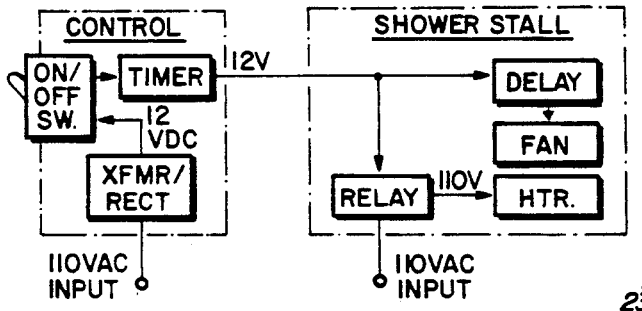
FIG. 20 is a schematic diagram of a control system for use with the dryer assembly.
Figure 21:
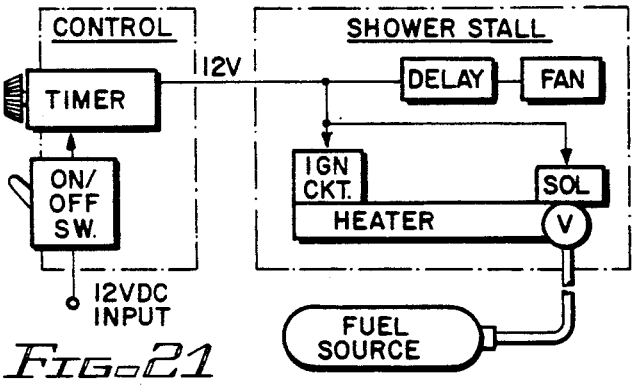
FIG. 21 is a schematic diagram of a control system for the dryer assembly shown in FIG. 22.

Various control systems which can be employed in the dryer assemblies are schematically illustrated in FIGS. 19–21. The control system of FIG. 19 is particularly desirable since it utilizes radio waves to actuate the blower fan and heating element and thus no "hard wiring" between the controls and the operating units is required. The control can be conveniently mounted near the entry to the shower stall and includes a source of 110 volt A.C. current which is supplied to a transformer/rectifier unit which in turn converts the 110 volt A.C. current to 12 volt D.C. current. The 12 volt D.C. current is supplied to a transmitter which is controlled by an on/off switch. Mounted to the transmitter unit is a small antenna. Mounted in the attic or crawl space area and conveniently near the blower unit and heating unit is a receiver provided with a suitable antenna to receive the radio waves from the transmitter of the control unit. The receiver is operably coupled to a timer which in turn is wired to a relay unit to which a source of 110 volt A.C. current is supplied. As shown in FIG. 19 the relay supplies 110 volt current to both the tubular heating element and to a delay switch. The purpose of the delay switch is to delay the operation of the blower until the heating unit has been on for a predetermined period of time. This is done so as not to blow cold air into the shower stall.

The transmitter portion could also be a hand held 9-volt transmitter as is used in radio controlled garage door openers.

The control system illustrated in FIG. 20 does not use radio waves to control the operation of the blower and heating element but utilizes 12 volt D.C. which is still a very safe wiring situation for the average homeowner. 110 volt A.C. current is supplied to a transformer/rectifier which in turn supplies 12 volt D.C. current through an on/off switch to a hand set timer unit. The purpose of the timer is to control the length of time that the blower and heating element are on and thus the supply of warm air to the bathing area. The timer in turn is connected by 12 volt wiring to a relay and a delay switch which can be located again in the attic or crawl space area near the blower and heating element. The relay is supplied with 110 volt A.C. current which, of course, is used to energize the tubular resistance heating element. A delay switch controls the fan so that the fan is not actuated until the heating element is at proper operating temperature.

FIG. 21 schematically illustrates a control system for use with the dryer assembly of FIG. 22. Since the assembly of FIG. 22 is designed for use in an RV, the fuel source is compressed propane or butane gas. The system utilizes 12 volt D.C. throughout. The controls include a suitable on/off switch and a timer which again functions to control the length of time that the system is in operation. The timer is connected by means of 12 volt wiring to both a delay switch and ignition circuit which again is mounted in the area immediately surrounding the dryer assembly. A solenoid valve is also connected by means of the 12 volt wiring. The 12 volt current activates the ignition circuit and solenoid valve to allow the flow of gas to the burner unit and to ignite the gas. As with other control systems a delay switch is provided which allows a preset period of time to elapse before the fan or blower is activated allowing the temperature within the heat exchanger to rise.

What is claimed is:

1. An assembly for efficiently delivering heated air into an enclosed area for drying the body of a person, said assembly designed to be mounted behind the walls and ceiling of said enclosed area, and wherein at least one of said walls is provided with openings through which heated air may be introduced into said enclosed area, said assembly comprising blower means, duct means connecting said blower means to said openings with a portion of said duct means being mounted immediately behind said wall and positioned immediately adjacent to said wall openings with the side of said duct means which is positioned adjacent to said wall openings being provided with openings communicating directly with said wall openings, and elongated tubular-shaped heating means mounted in the interior of said duct means and downstream from said blower means and positioned directly opposite to at least one of said openings, said heating means provided with additional means to enhance the transfer of heat to air moving in said duct means.

2. The assembly of claim 1 wherein said means to enhance the transfer of heat to said moving air includes a heat reflecting plate positioned between said heating means and said wall.

3. The assembly of claim 2 wherein said duct means are 3-sided and generally U-channel shaped in cross section in the area where said duct means is adjacent to said wall openings and wherein the open side of said duct means is immediately adjacent said wall.

4. The assembly of claim 3 wherein the bottom portion of said duct means which is not adjacent to said openings is 4 sided and provided with an end wall.

5. The assembly of claim 4 wherein said heat reflecting plate is metal.

6. The assembly of claim 5 wherein said duct means is tapered from side to side in a manner whereby the cross sectional area of said duct means further from said blower means is less than the cross sectional area of said duct means which are closer to said blower means.

7. The assembly of claim 1 wherein said heating means are mounted to a plate slideably positioned in said duct means.

8. The assembly of claim 7 wherein said duct means is formed of at least 2 sections.

9. The assembly of claim 1 wherein said additional means to enhance the transfer of heat is a series of spaced apart lateral projections which surround said heating means.

10. The assembly of claim 9 wherein said heating means is mounted to a plate slideably positioned in said duct, with a series of spaced apart lateral projections secured to said plate and which projections engage said heating element in said duct.

11. The assembly of claim 10 wherein said projections are formed by cutting through a portion of said plate and thereafter bending said cut portion in a manner so that it forms a projection lateral to said plate.

12. An assembly for delivering heated air into a bathing area, said assembly designed to be mounted in an area adjacent to the wall of said bathing area, and wherein said wall is provided with openings through which heated air may be introduced into said bathing area, said assembly comprising a generally cylindrically shaped and enclosed heat exchanger mounted in said area adjacent to said wall of said bathing area, means to supply heat to the interior of said heat exchanger, said heat exchanger surrounded by a substantially enclosed chamber which functions as a plenum for said heat exchanger, blower means to circulate air within said chamber about said heat exchanger and into said bathing area via said openings and means for controlling said blower means and said heat means.

13. The assembly of claim 12 wherein said heat means uses a gas and wherein said blower means and said heat means are actuated by a control system employing 12 volt D.C. current.

14. The assembly of claim 12 wherein said blower means and said heat means are actuated by a control system employing 110 volt A.C. current.

* * * * *